US005893644A

United States Patent [19]

Derby

[11] Patent Number: 5,893,644

[45] Date of Patent: Apr. 13, 1999

[54] GLUE BOTTOM BULK CONTAINER

[75] Inventor: Norwin C. Derby, Dallas, Tex.

[73] Assignee: Super Sack Mfg. Corp., Dallas, Tex.

[21] Appl. No.: 08/899,126

[22] Filed: Jul. 23, 1997

Related U.S. Application Data

[60] Division of application No. 08/566,076, Dec. 1, 1995, Pat. No. 5,702,340, which is a continuation-in-part of application No. 08/160,229, Dec. 2, 1993, Pat. No. 5,490,828.

[51] Int. Cl.[6] ..... B65D 30/10

[52] U.S. Cl. ..... 383/117; 383/121

[58] Field of Search ..... 383/104, 121, 383/117

[56] References Cited

U.S. PATENT DOCUMENTS

| | | | |
|---|---|---|---|
| 2,221,617 | 11/1940 | Steen . | |
| 2,673,024 | 3/1954 | Kuss | 383/121 |
| 2,817,474 | 12/1957 | Abramson | 383/121 |
| 2,929,544 | 3/1960 | Herschler . | |
| 4,133,280 | 1/1979 | Takatori et al. . | |
| 4,143,796 | 3/1979 | Williamson et al. . | |
| 4,194,652 | 3/1980 | Williamson et al. . | |
| 4,221,250 | 9/1980 | Manerba . | |
| 4,284,229 | 8/1981 | Schmidt et al. | 383/121 |
| 4,365,459 | 12/1982 | Grundler . | |
| 4,457,456 | 7/1984 | Derby et al. . | |
| 4,479,243 | 10/1984 | Derby et al. . | |
| 4,493,109 | 1/1985 | Nattrass . | |
| 4,553,668 | 11/1985 | James et al. | 383/121 |
| 4,584,705 | 4/1986 | Myklebust et al. | 383/121 |
| 4,664,044 | 5/1987 | Gazzarrini . | |
| 4,759,473 | 7/1988 | Derby et al. . | |
| 4,790,029 | 12/1988 | LaFleur et al. | 383/121 |
| 4,903,859 | 2/1990 | Derby et al. . | |
| 4,927,075 | 5/1990 | Lisiecki . | |
| 5,110,037 | 5/1992 | Pieritz, Sr. . | |
| 5,127,893 | 7/1992 | Lafleur . | |
| 5,230,689 | 7/1993 | Derby . | |
| 5,244,280 | 9/1993 | Porter et al. . | |
| 5,695,287 | 12/1997 | Derby | 383/121 |
| 5,758,973 | 6/1998 | LaFleur | 383/121 |

FOREIGN PATENT DOCUMENTS

| | | |
|---|---|---|
| 2457533 | 8/1975 | Germany . |
| 1385286 | 2/1975 | United Kingdom . |

*Primary Examiner*—Stephen P. Garbe
*Attorney, Agent, or Firm*—Michael A. O'Neil

[57] ABSTRACT

An eight sided flexible intermediate bulk container formed from a substantially flat bottom wall of woven fabric with a first side, a second side, a peripheral edge surrounding the first and second side, and an octagonal horizontal cross sectional area. The container is further formed from a tubular sidewall blank of a woven fabric with a sidewall, an exterior side, an interior side, a first end, a second end, a first portion of the sidewall proximate to the second end, the first portion being cut in a sawtooth configuration including a plurality of adjacent triangular shaped flaps, a second portion of the sidewall proximate to the second end, and an interior cross section of size and octagonal shape for receiving the bottom wall. The bottom wall is positioned inside the first portion of the tubular blank perpendicular to the longitudinal axis of the tubular blank, wherein the peripheral edge of the bottom wall contacts the interior sidewall a predetermined distance from the first end, and the first side of the bottom wall is disposed toward the first end of the blank and the second side of the bottom wall is disposed toward the second end of the blank. The adjacent triangular shaped flaps of the first portion of the side wall blank are folded toward the bottom wall with the interior side of the triangular shaped flaps being affixed with adhesive to the first side of the bottom wall.

1 Claim, 5 Drawing Sheets

GLUE BOTTOM BULK CONTAINER

RELATED APPLICATIONS

This application is a divisional application of Ser. No. 08/566,076, filed Dec. 1, 1995, now U.S. Pat. No. 5,702,340, which is a continuation-in-part of Ser. No. 08/160,229, filed Dec. 2, 1993, now U.S. Pat. No. 5,490,828, issued Feb. 13, 1996.

TECHNICAL FIELD

This invention relates to flexible bulk containers and, more particularly, to bulk containers having a glued bottom and process for manufacturing the same.

BACKGROUND OF THE INVENTION

Historically, flexible bulk containers have been used for receiving, storing, transporting and discharging flowable materials of all types. The containers are typically constructed in a square, vertically rectangular or circular shape with lift straps attached to each of the uppermost corners of the square, rectangle or circle.

By way of example, the flexible bulk containers are used for handling granular, liquid or powder (flowable) materials such as chemicals, minerals, fertilizers, foodstuffs, grains and agricultural products. The advantages of such receptacles include relatively low weight, reduced cost, versatility and, in the case of reusable receptacles, low return freight costs.

At the present time most flexible bulk containers are manufactured from woven polypropylene fabric. Typically, such containers are constructed by stitching or sewing together two or more sidewalls and a bottom portion. Optionally, a top portion, lift straps or other structural support can be added to this basic construction. The traditional method of securing the seams of the several portions of the container includes sewing or stitching, a time-consuming, labor-intensive and therefore expensive process. Usually, attachment of the bottom portion to the remaining piece or pieces, a critical step in the manufacture of a container, consumes the most time, labor and expense. Thus a need has arisen for a method of construction of a container wherein the bottom panel is quickly, easily and inexpensively attached to the container.

Furthermore, needle holes created in the stitching process allow powdered materials to sift through the holes. Thus a need has arisen for a method of construction of a container that does not use conventional stitching for the bottom seams.

SUMMARY OF THE INVENTION

The instant invention overcomes the foregoing and other problems associated with the prior art by providing a method of construction of a container wherein the bottom wall of the container is quickly, easily and inexpensively secured to the container.

According to the instant invention, a sidewall blank may be constructed by securing one or more sidewalls together to form a container lacking a top and a bottom. Alternatively, a circular woven fabric tube may function as the sidewall blank. For purposes of this application, the term "sidewall blank" will be used to refer to containers lacking a top wall and a bottom wall and constructed from either a single sheet of material or any number of sidewalls secured together.

In a first embodiment of the invention, the flexible bulk container has an octagonal horizontal cross section. A single sheet of material of rectangular shape has the top cut in a sawtooth manner in a series of eight isosceles triangles spaced equally along the top. Alternatively, eight individual sidewalls may be secured together to form a single sheet with the isosceles triangles again spaced along the top. The rectangular sheet is formed into the sidewall blank having an open top and open bottom by bringing two opposing ends together and securing them to each other in a conventional manner. The isosceles triangles are positioned along the top of the sidewall blank.

Next, the sidewall blank is attached to a carriage and suspended over an octagonal work table by a structural support. The structural support includes a raised work platform designed to place a worker in an optimum position for attaching the bottom wall to the sidewall blank to form a container. From the raised work platform, a worker can secure the sidewall blank to the carriage, position the sidewall blank over the work table and perform the steps necessary to secure the bottom wall to the sidewall blank to form a container. The work table includes a hole at its center so that an access spout, if any, located in the bottom wall can be accommodated during the construction process.

Since the sidewall blank lacks a top wall and bottom wall at this stage in the construction, the carriage of the structural support includes outwardly-movable support arms capable of supporting the sidewall blank by stretching the flexible material of the sidewall blank into the shape of an octagon or square. The opposing force of the support arms at the sides of the sidewall blank simultaneously supports the sidewall blank and shapes the sidewall blank for receiving the bottom wall.

In the next step of the instant invention, an octagonal bottom wall is positioned on the work table beneath the suspended sidewall blank. Adhesive or glue is then applied to the bottom wall in areas which will come into contact with the sidewall blank.

Subsequent to placement of the adhesive or glue, the sidewall blank is lowered into contact with the bottom wall. The length of the sidewall blank is then draped down and over the work table so that the portions of the sidewall blank which will contact the adhesive or glue on the octagonal bottom wall are accessible to the worker. Each of the isosceles triangles are folded inwardly toward a central vertical axis of the sidewall blank and downwardly to contact the octagonal bottom. In the final steps of the construction process of the present invention, the isosceles triangles are secured to the bottom wall by one or more of several methods. The triangles may be secured with glue, adhesive or conventional sewing techniques. Alternatively, a first component of an adhesive may be applied to the bottom and a second component of adhesive applied to the top of the sidewall blank, such that the two part adhesive forms a bond when the first component and second component come in contact with each other. Once the triangles are secured, the flexible bulk container is formed and is ready for the attachment of optional features such as lift straps or a top wall.

In a second embodiment of the current invention, a continuous circular woven tube is cut perpendicular to its central axis in a sawtooth manner, forming a continuously woven sidewall blank with isosceles triangles along the top. The complementary portion of the circular woven tube from which the sidewall blank was cut may be used as the top of a consecutive sidewall blank.

The continuously woven sidewall blank is attached to a carriage suspended over the octagonal work table by a structural support as was Previously described. An octagonal bottom is positioned on the work table beneath the suspended blank. Adhesive or glue is applied to the areas that will come in contact with the continuously woven sidewall blank. The circular woven sidewall blank is lowered into contact with the octagonal bottom and each of the isosceles triangles are secured to the bottom as previously described. Once the triangles are secured, the flexible bulk container is formed and ready for attachment of optional features such as lift straps and/or a top wall.

In a third embodiment, the flexible bulk container has a circular horizontal cross section. A single rectangular sheet is formed into a sidewall blank having an open top and open bottom by bringing the ends together and securing them to each other in a conventional manner. The sidewall blank is attached to a carriage and suspended over a round work table by a structural support as previously described. The work table includes a hole at its center so that an access spout, if any, located in the bottom wall can be accommodated during the construction process.

A round bottom wall is positioned on the work table beneath the suspended sidewall blank. Adhesive or glue is then applied to the bottom wall in areas which will come into contact with the sidewall blank.

Subsequent to placement of the adhesive or glue, the sidewall blank is lowered into contact with the bottom wall. The length of the sidewall blank is then draped down and over the work table so that the portions of the sidewall blank which will contact the adhesive or glue on the round bottom wall are accessible to the worker. Fins are formed at regular intervals along the top of the sidewall blank to take up the surplus material created when the top of the cylindrical sidewall blank is folded inwardly into contact with the round bottom. In the final steps of the construction process of the present invention, the fins are folded, cut and/or secured to the bottom wall by one or more of several methods as described above. Once the fins are secured, the container is formed and is ready for the attachment of optional features such as lift straps or a top wall.

In a fourth embodiment of the current invention, a continuous circular woven tube is cut perpendicular to its central axis, forming a continuously woven sidewall blank. The continuously woven sidewall blank is attached to a carriage suspended over the circular work table by a structural support as was previously described. A circular bottom is positioned on the work table beneath the suspended blank. Adhesive or glue is applied to the areas that will come n contact with the continuously woven sidewall blank. The circular woven sidewall blank is lowered into contact with the circular bottom.

Fins are formed at regular intervals along the top of the sidewall blank to take up the surplus material created when the top of the cylindrical sidewall blank is folded inwardly into contact with the round bottom. In the final steps of the construction process of the present invention, the fins are folded, cut and/or secured to the bottom wall by one or more of several methods as described above. Once the fins are secured, the container is formed and is ready for the attachment of optional features such as lift straps or a top wall.

BRIEF DESCRIPTION OF THE DRAWINGS

A more complete understanding of the invention may be had by reference to the following Detailed Description when taken in conjunction with the accompanying Drawings in which.

DETAILED DESCRIPTION

Figure 1:
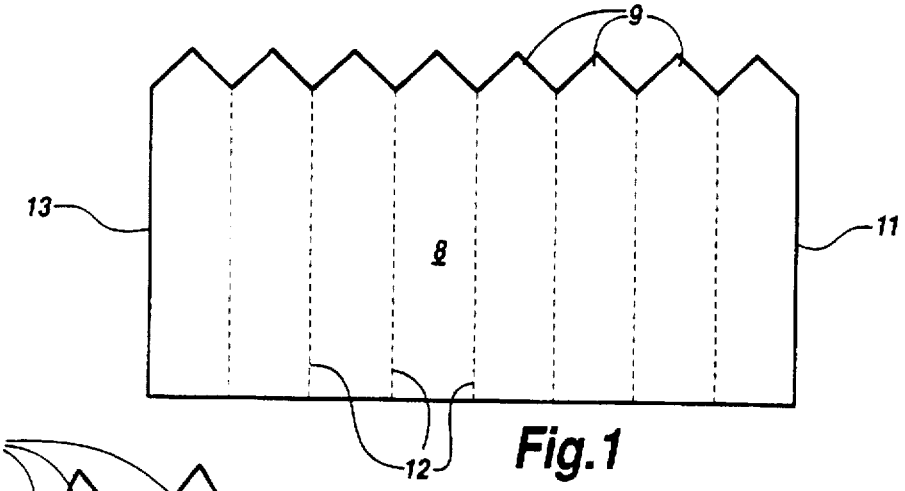
FIG. 1 is a plan view, showing a sidewall for a flexible bulk container.

Referring now to FIG. 1, there is shown a plan view of a generally rectangular shaped sheet of material 8 that has the top cut in a sawtooth manner with a series of eight isosceles triangles 9 equally spaced along the top. The location of future fold lines 12 are indicated by dashed lines.

Figure 2:
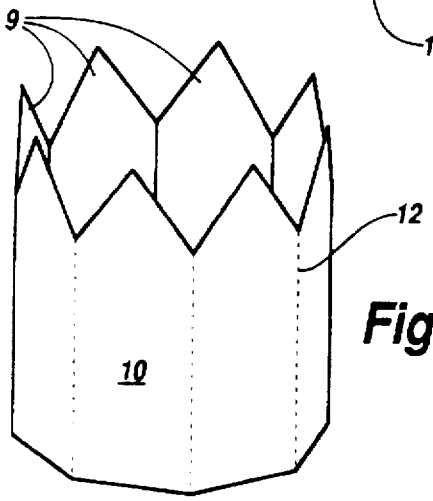
FIG. 2 is a perspective view, showing an octagonal sidewall blank.
Figure 3:
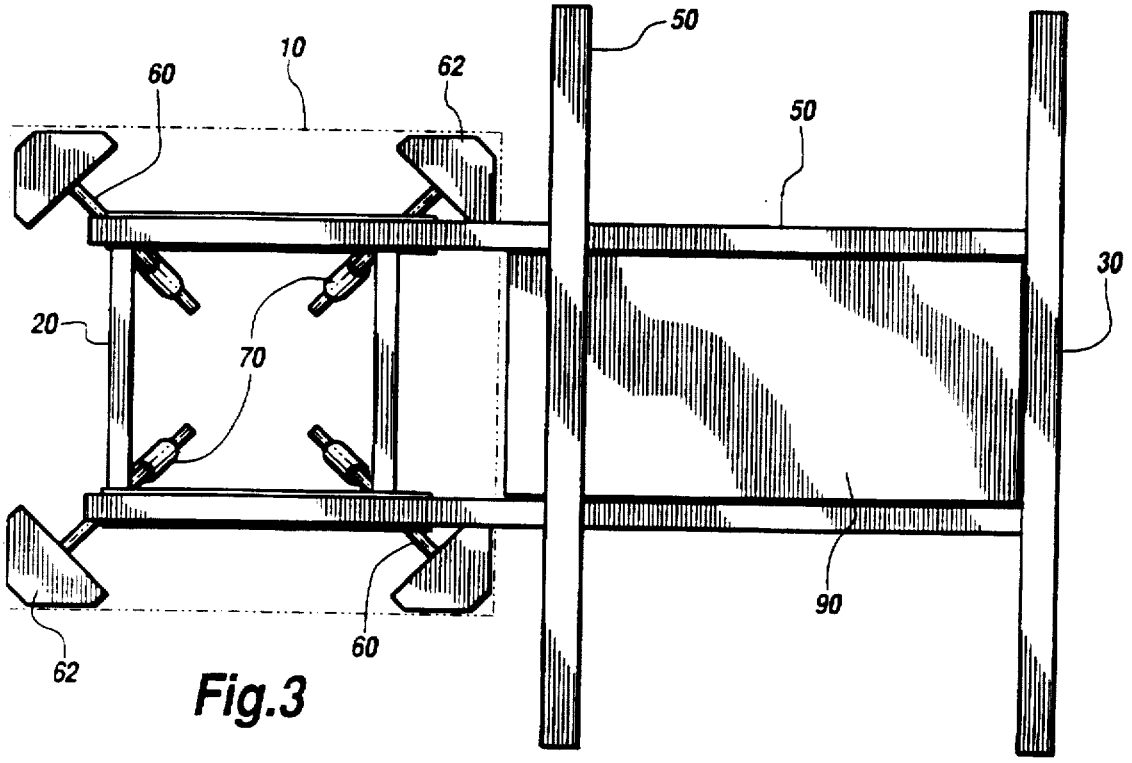
FIG. 3 is a top view showing a support structure and carriage used in the process of manufacturing the invention.
Figure 4:
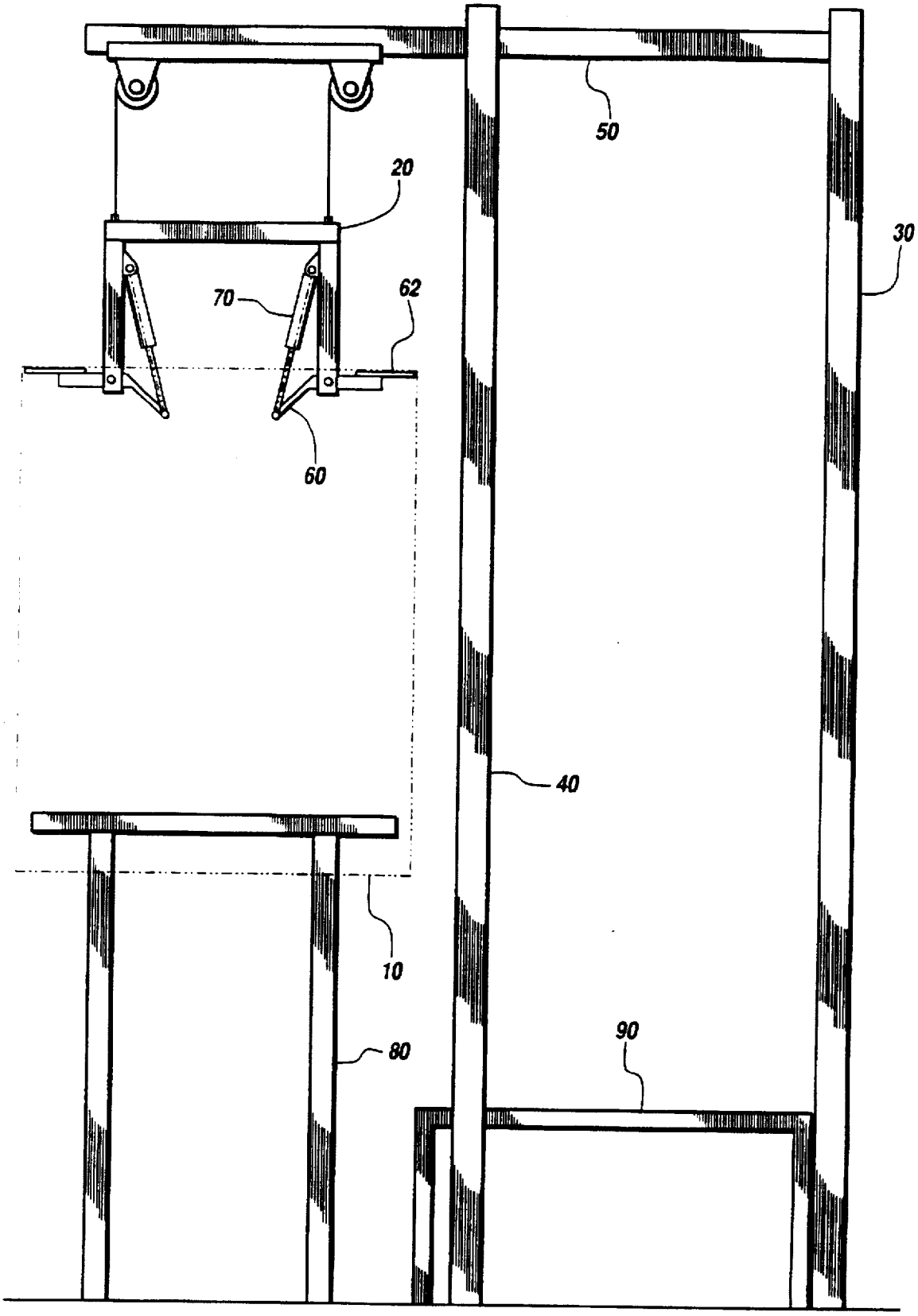
FIG. 4 is a side view, showing the support structure and carriage used in the manufacture of the invention.

FIG. 2 displays a sidewall blank 10, constructed from a single rectangular sheet 8 (see FIG. 1). For purposes of this application a "sidewall blank" will be used to refer to containers lacking a top wall and a bottom wall. Isosceles triangles 9 are positioned along the top of the sidewall blank 10. Referring to FIGS. 1 and 2, sidewall blank 10 has an octagonal horizontal cross section formed by joining ends 11 and 13 of rectangular sheet 8 together and folding along fold lines 12. Referring to FIGS. 3 and 4, once the sidewall blank 10 is formed, it is attached to a carriage 20 of a structural support 30. The structural support 30 is formed of wood, steel or other suitable materials to provide support to the sidewall blank during the instant construction process and to provide optimum placement of the worker in charge of performing the instant construction process. The structural support 30 comprises one or more vertical support members 40 and one or more horizontal support members 50. Attached to one or more of the horizontal support members 50 is the carriage 20. The carriage 20 includes outwardly-movable support arms 60 shaped at their tips 62 to form corners in the sidewall blank 10 when extended. In the first embodiment of the invention, four support arms 60 are used to form the shape of a square. Other embodiments utilize more or less support arms 60 to form other shapes. For example, by using three support arms 60, a triangular shape would be imparted to the sidewall blank 10. FIG. 3 is a top view of the structural support 30 demonstrating a sidewall blank 10 being held by the support arms 60 in a square shape. The support arms 60 function to suspend and hold the sidewall blank 10 open over the work table. It is not necessary that the number of support arms equal the number of sides in a sidewall blank.

Referring again to FIG. 4, the sidewall blank 10 is attached to the carriage 20 by placing the top end of the sidewall blank 10 around, and extending, the support arms 60. The support arms 60 are automatically extended by spring-loaded or hydraulic means 70. Once attached, the carriage 20 is positioned by the worker over a raised work table 80 for the remaining steps of the construction process. The work table 80 is raised to facilitate later steps in the construction process where the length of the sidewall blank 10 is released from the carriage 20 and is draped over the work table 80.

Figure 5:
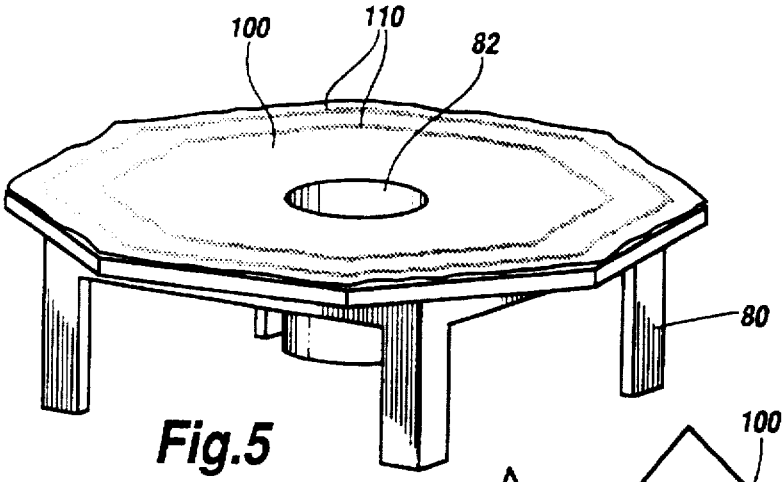
FIG. 5 is a partial perspective view, showing an octagonal work table and octagonal bottom for the flexible bulk container.

Referring to FIG. 5, a hole 82 is included in the surface of the work table 80 to accommodate a fill-spout, if any, on the bottom wall 100 of the container. The work table will preferably have a horizontal cross section slightly smaller than the cross section of the sidewall blank 10 to allow the lower portion of the sidewall blank 10 to pass over the work table 80. Referring to FIG. 4, beneath the structural support 30 and aligned with the work table 80 is a raised platform 90 for a worker. Standing on the platform 90, a worker can quickly and easily attach the sidewall blank 10 to the carriage 20 and position the sidewall blank 10 over the work table 80.

Referring to FIG. 5, once the sidewall blank 10 is suspended over the work table 80, a bottom wall 100 is positioned on the surface of the work table 80. The hole 82 in the surface of the work table 80 accommodates an access spout, if any, in the bottom wall 100. Next an adhesive or glue 110 is applied to the upper surface of the bottom wall 100. Although the adhesive or glue 110 is shown to be applied in a generally octagonal pattern along the periphery of the bottom wall 100, any pattern of application can be used, if desired.

Figure 6:
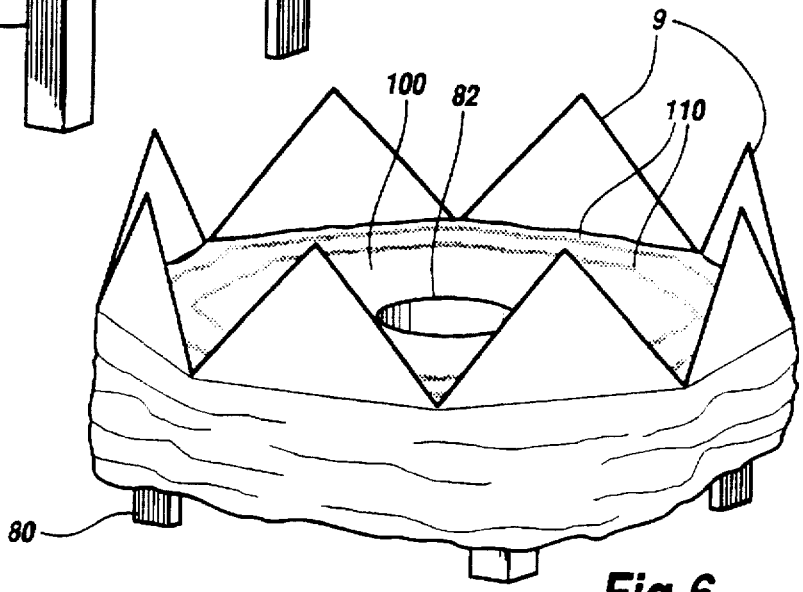
FIG. 6 is a perspective view, showing an octagonal sidewall blank draped over the octagonal work table and octagonal bottom wall of FIG. 5.

Now referring to FIG. 6, in the next step of the instant construction process, the sidewall blank 10 is lowered into contact with the bottom wall 100 resting on the work table 80. The sidewall blank 10 is then disconnected from the carriage 20, allowing the remaining length of the sidewall blank 10 to drape down the sides of the work table 80. Each of the isosceles triangles 9 are folded inwardly toward a central vertical axis of the sidewall blank 10 to contact the octagonal bottom wall 100.

In the final steps of the construction process of the present invention, the isosceles triangles 9 are secured to the bottom wall 100 by one or more of several methods. The isosceles triangles 9 may be secured with glue, adhesive or conventional sewing techniques. Alternatively, a first component of an adhesive may be applied to an upper surface of the bottom wall 100 and a second component of adhesive applied to the top inside of the sidewall blank 10, such that the two part adhesive forms a bond when the first component and second component come in contact with each other. Once the isosceles triangles 9 are secured, the container is formed and is ready for the attachment of optional features such as lift straps or a top wall.

Figure 7:
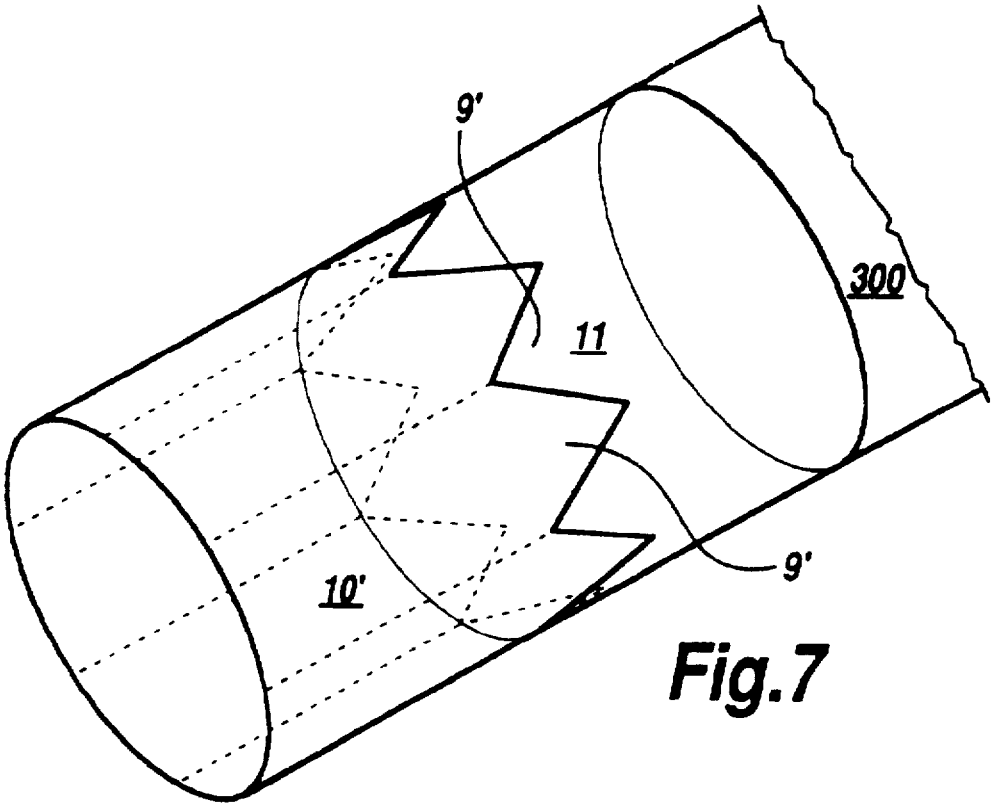
FIG. 7 is a perspective view, showing a series of octagonal sidewall blanks cut from a continuously woven circular tube.

Referring to FIG. 7 there is illustrated a second embodiment of the present invention. A continuous circular woven tube 300 is provided directly from a loom or storage. The tube 300 is cut perpendicular to its central axis in a sawtooth manner, forming a continuously woven sidewall blank 10' with isosceles triangles 9' along the top. The complementary portion of the circular woven tube 300 from which the sidewall blank was cut may be used as the top of a consecutive sidewall blank 10.

Returning to FIGS. 3 through 6, the below described elements designated by (') reference numerals replace those like numbered elements illustrated in the drawings without the (') designation. The continuously woven sidewall blank 10' is attached to a carriage 20 suspended over the octagonal work table 80 by a structural support 30 as was previously described. A bottom wall 100 is positioned on the work table beneath the suspended blank. Adhesive or glue 110 is applied to the areas that will come in contact with the continuously woven sidewall blank. The circular woven sidewall blank 10' is lowered into contact with the bottom wall 100 and each of the isosceles triangles 9' are secured to the bottom as previously described. Once the isosceles triangles 9' are secured, the flexible bulk container is formed and ready for attachment of optional features such as lift straps and/or a top wall.

Figure 8:
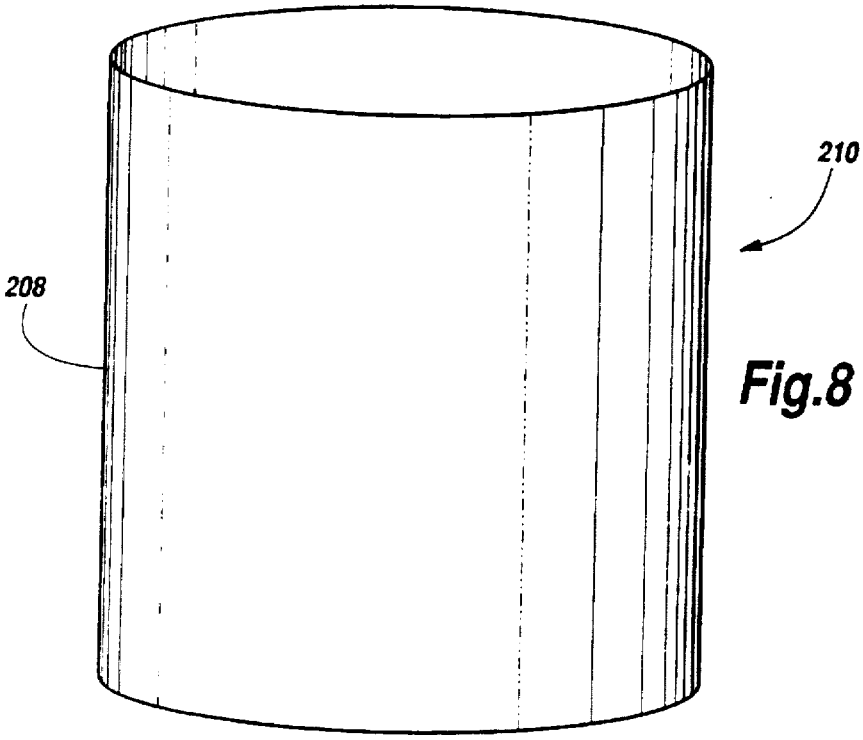
FIG. 8 is a perspective view, showing a circular sidewall blank formed by joining opposing ends of a flat panel together.

Referring to FIGS. 8 and 10 through 13 there is illustrated a third embodiment of the present invention. Turning now to FIG. 8, a single rectangular sheet 208 is formed into a cylindrical sidewall blank 210 having an open top and open bottom by bringing the ends together and securing them to each other in a conventional manner. As was previously illustrated in FIGS. 3 and 4, the sidewall blank is attached to a carriage and suspended over a round work table by a structural support.

Figure 10:
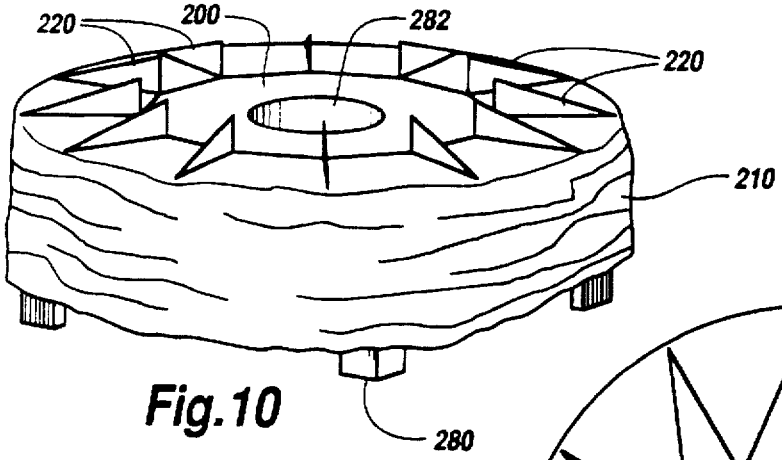
FIG. 10 is a perspective view, showing a circular sidewall blank secured to a circular bottom wall resting on a circular work table.

Referring to FIG. 10, a round bottom wall 200 is positioned on a work table 280 beneath the suspended sidewall blank 210. The work table 280 includes a hole 282 at its center so that an access spout, if any, located in the bottom wall 200 can be accommodated during the construction process. Adhesive or glue is then applied to the bottom wall in areas which will come into contact with the sidewall blank 210.

Figure 11:
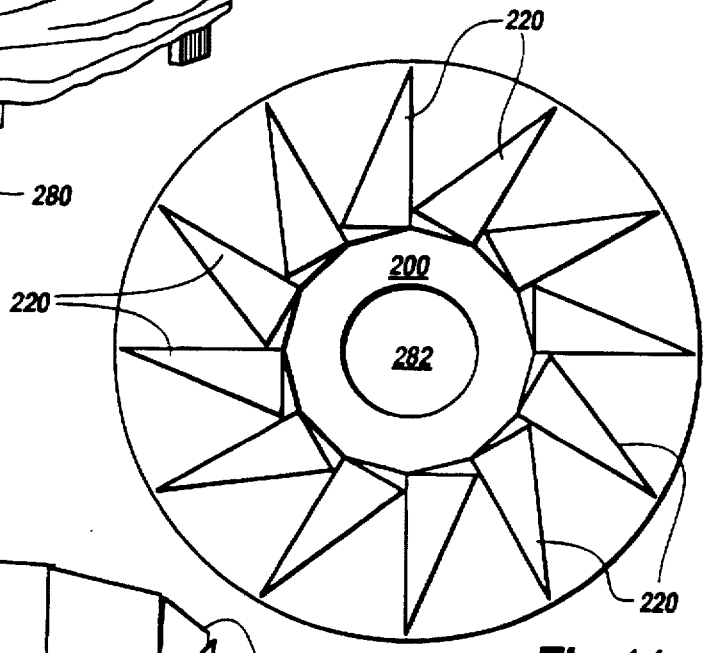
FIG. 11 is a top view, showing a circular sidewall blank demonstrating fins of the sidewall blank folded and secured to the bottom wall.

Subsequent to placement of the adhesive or glue, the sidewall blank is lowered into contact with the bottom wall 200. The length of the sidewall blank 210 is then draped down and over the sides of the work table 280 so that the portions of the sidewall blank 210 which will contact the adhesive or glue on the round bottom wall 200 are accessible to the worker. Fins 220 are formed at regular intervals along the top of the sidewall blank 210 to take up the surplus material created when the top of the cylindrical sidewall blank 210 is folded inwardly into contact with the round bottom wall 200. Referring to FIG. 11, in the final steps of the construction process of the present invention, the fins 220 are folded, cut and/or secured to the bottom wall 200 by one or more of several methods as described above. Once the fins 220 are secured, the container is formed and is ready for the attachment of optional features such as lift straps or a top wall. The corners of the fins 220 can be pre-sewn to provide additional support. This latter option is particularly helpful in applications where the bag will be subjected to elevated temperatures which might cause adhesives and/or glues to soften.

The fins 220 may be folded in different directions (not shown) and secured with adhesive or glue to the bottom wall 200.

Figure 12:
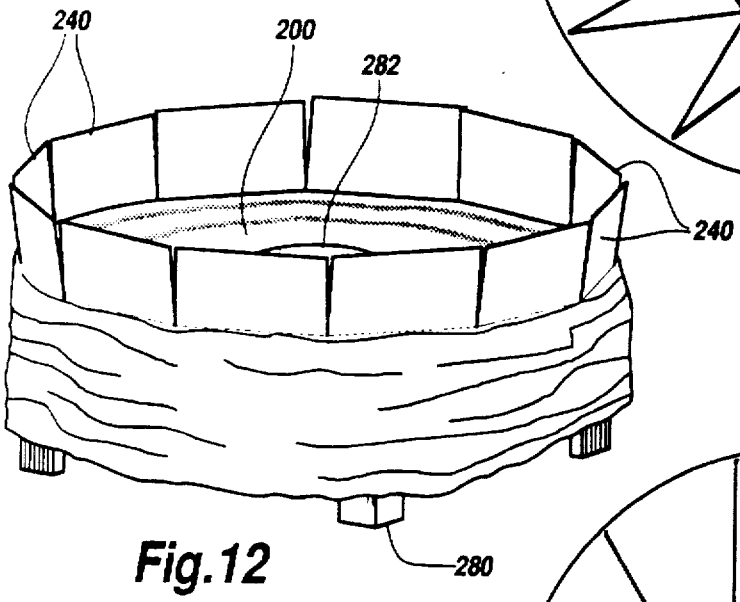
FIGS. 12 and 13 are a perspective view and a top view, respectively, showing a circular sidewall blank with the fins being cut and secured in an alternative manner.
Figure 13:
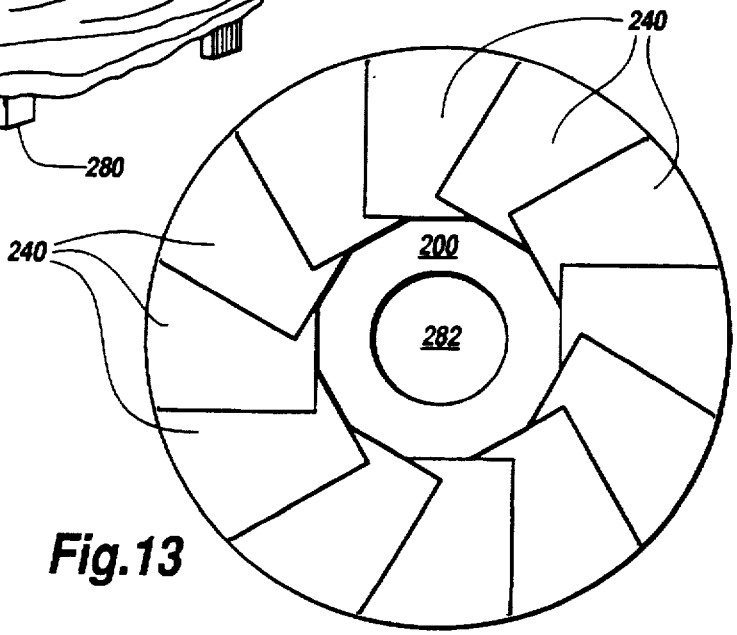

In FIGS. 12 and 13, an alternative step of folding and securing the fins 220 is illustrated. In this embodiment, the upper portion of the sidewall blank 210 is periodically cut to form flaps 240 and flaps 240 are folded over each other and secured to the bottom wall 200.

Figure 9:
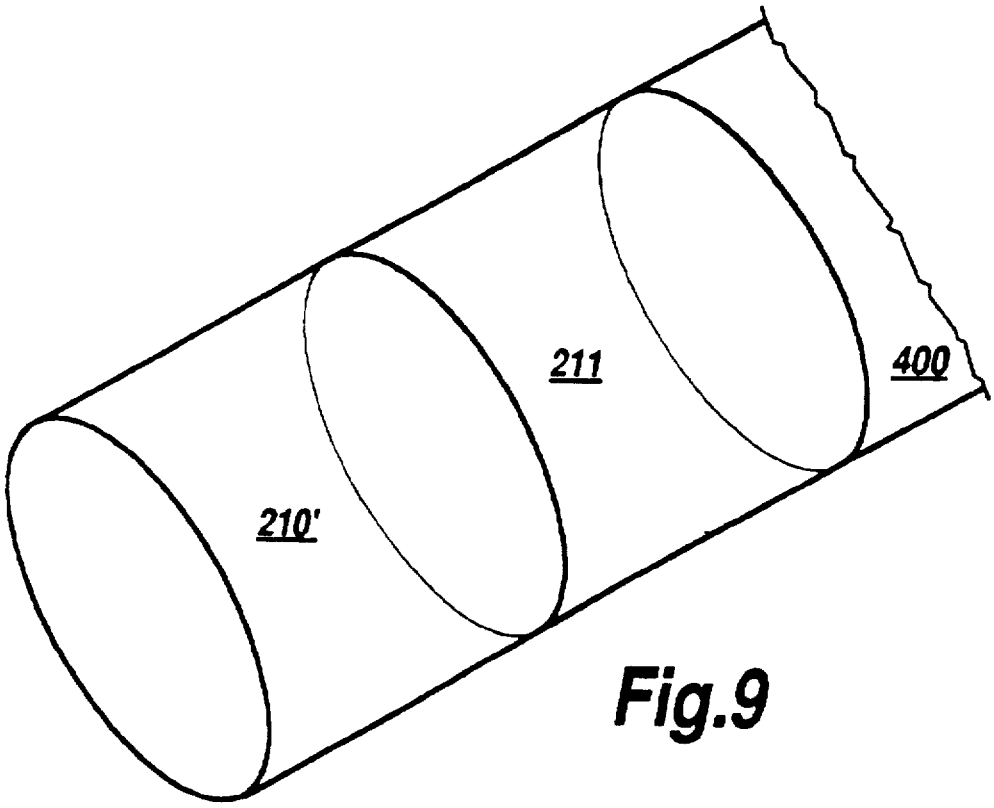
FIG. 9 is a perspective view, showing a series of circular sidewall blanks cut from a continuously woven circular tube.

Referring to FIG. 9 there is illustrated a fourth embodiment of the present invention. A continuous circular woven tube 400 is provided directly from the loom or from storage. The tube 400 is cut perpendicular to its central axis, forming a continuously woven sidewall blank 210'. Consecutive continuously woven sidewall blanks 211 are cut from the remaining portion of the circular woven tube 400.

Returning to FIGS. 3, 4 and 10 through 13, the below described elements designated by (') reference numerals replace those like numbered elements illustrated in the drawings without the (') designation. As was previously illustrated in FIGS. 3 and 4, the continuously woven sidewall blank is attached to a frame and suspended over a round work table by a structural support. A bottom wall 200 is positioned on the work table beneath the suspended blank. Adhesive or glue is applied to the areas that will come in contact with the continuously woven sidewall blank. The circular woven sidewall blank 210' is lowered into contact with the bottom wall 200 and secured as previously described. The flexible bulk container is formed and ready for attachment of optional features such as lift straps and/or a top wall.

Embodiments for flexible bulk bags having octagonal and circular cross sections have been disclosed; however, it is understood that any number of potential cross-sectional shapes may be used to form flexible bulk containers by the method disclosed. It should be understood that the invention is not limited to the embodiments disclosed, but is intended to embrace any alternative, modifications, rearrangements, or substitutes of parts or elements as fall within the spirit and scope of the invention.

I claim:

1. An eight sided flexible intermediate bulk container comprising:

a substantially flat bottom wall of woven fabric having:

a first side, a second side, a peripheral edge surrounding the first and second side, and an octagonal horizontal cross sectional area;

a tubular sidewall blank of woven fabric having:

a sidewall, an exterior side, an interior side, a first end, a second end, a first portion of the sidewall proximate to the first end, said first portion being cut in a sawtooth configuration including a plurality of adjacent triangular shaped flaps, a second portion of the sidewall proximate to the second end, and an interior cross section of size and octagonal shape for receiving the bottom wall;

said bottom wall positioned inside the first portion of said tubular blank perpendicular to the longitudinal axis of the tubular blank, wherein the peripheral edge of the bottom wall contacts the interior sidewall a predetermined distance from the first end, and having the first side of the bottom wall disposed toward the first end of the blank and the second side of the bottom wall disposed toward the second end of the blank; and said adjacent triangular shaped flaps of the first portion of the side wall blank being folded toward the bottom wall with the interior side of said triangular shaped flaps being affixed with adhesive to the first side of said bottom wall.

* * * * *

UNITED STATES PATENT AND TRADEMARK OFFICE

CERTIFICATE OF CORRECTION

PATENT NO. : 5,893,644

DATED : April 13, 1999

INVENTOR(S): Norwin C. Derby

It is certified that error appears in the above-identified patent and that said Letters Patent is hereby corrected as shown below:

On the title page, item [56]:

Under the "References Cited" please add the following two documents:

1. "Get the Operator Out From Under the Bag" With the New Remote Opening Discharge Spout (R.O.D.S.™) Super Sack® Container, Super Sack Containers Technical Bulletin No. 60201.

2. "Super Sack® Woven Polypropylene Flexible Semi-Bulk Container for Shipping/Handling/Storing Dry-Flowable, Semi-Bulk Materials, The Real "Bag" That Will Stand Up!", Super Sack Containers Technical Bulletin No. 871101.

Column 3, line 1, replace "Previously" with --previously--.

Column 3, line 47, replace "come n" with --come in--.

Signed and Sealed this

Twenty-first Day of March, 2000

*Attest:*

*Attesting Officer*

Q. TODD DICKINSON

*Commissioner of Patents and Trademarks*